United States Patent [19]

Kau

[11] Patent Number: 4,802,072

[45] Date of Patent: Jan. 31, 1989

[54] DIRECTION FIXTURE FOR DECORATIVE LAMP SERIES

[76] Inventor: Chuan F. Kau, 550, Chung Shan Rd., Hsin Chu City, Taiwan

[21] Appl. No.: 16,649

[22] Filed: Feb. 19, 1987

[51] Int. Cl.[4] ..... F21V 1/00

[52] U.S. Cl. ..... 362/238; 362/806

[58] Field of Search ..... 362/249, 237, 238, 123, 362/391, 806, 439, 388, 250

[56] References Cited

U.S. PATENT DOCUMENTS 1,980,948 6/1934 Abramson ..... 362/123

2,453,695 3/1946 Belling ..... 362/123

4,679,126 7/1987 Van Sickler ..... 362/237

*Primary Examiner*—Martin P. Schwadron

*Assistant Examiner*—Sue Hagarman

*Attorney, Agent, or Firm*—Mason, Fenwick & Lawrence

[57] ABSTRACT

A direction fixture, particularly to that attached on the socket, comprises a retaining ring having an elastic access notch for retaining the electric wires of the decorative lamp series to fix the direction of the series of socket, namely, the lamps on respective socket can be arranged in a certain direction in series.

5 Claims, 1 Drawing Sheet

DIRECTION FIXTURE FOR DECORATIVE LAMP SERIES

This invention relates to a direction fixture, particularly to that used for decorative lamp series.

Conventional decorative lamp series, as partly shown in FIG. 1, is formed by connecting two electric wires 11 and 12 from the bottom of each socket 10, then extending both wires 11 and 12 in counter direction and twisting them together with corresponding wires from adjacent socket 10. Since the wires 11 and 12 are respectively connected from the socket 10, so that the socket 10 will erect radically with respect to the lamp series in a suspension state of unstable tendency. Moreover, the directions of all socket 10 are not identically fixed in certain direction. In this case, the bulbs 13 on the respective socket 10 would not become linear arrangement, even the interval between adjacent bulbs 13 would not in similar. Thus, during twinkling of the bulbs a flowing effect in certain streamline would not be reached.

The primary object of this invention is to provide a direction fixture attached on the socket, which comprises a retaining ring having an elastic access notch for retaining the electric wires of the lamp series so as to fix the direction of the series of sockets.

Other objects and features of this invention will be apparent from the following description of the embodiments with reference to the accompanying drawings, in which.

Figure 1:
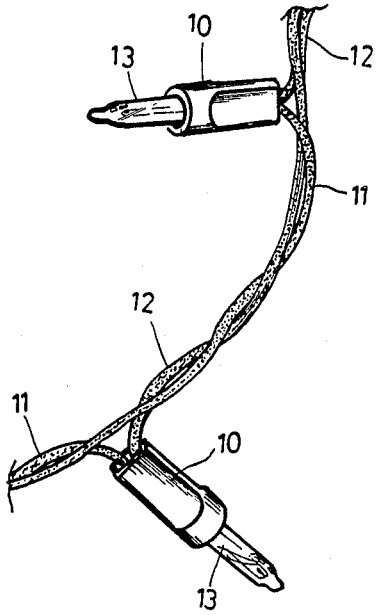
FIG. 1 PRIOR ART
FIG. 1 is a fragmentary perspective view showing prior art of decorative lamp series.
Figure 2:
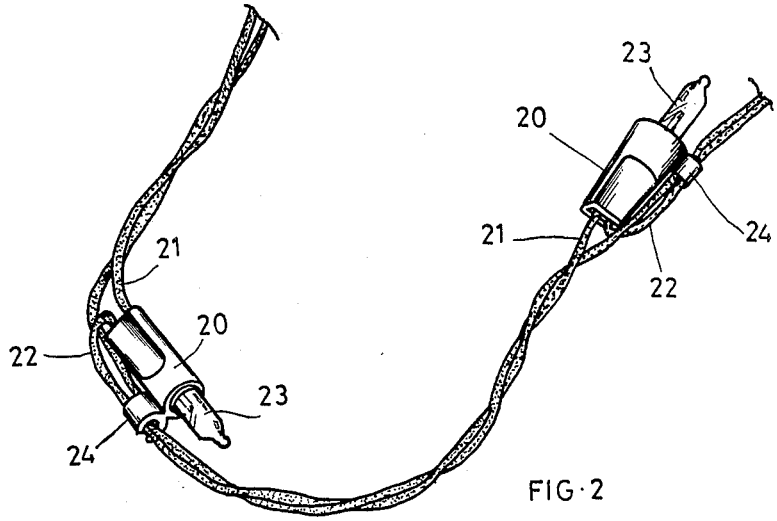
FIG. 2 is a fragmentary perspective view showing an embodiment of the direction fixture for decorative lamp series according to the present invention.

Now, referring to FIG. 2, two electric wires 21 and 22 are connected from the bottom of each socket 20 and twisted as usual. But the characteristic of this invention is that the socket 20 is attached with a direction fixture 24 which retains the twisted wires 21 and 22 to fix the socket 20 in the direction such as shown in FIG. 2 or in the reverse direction. Since the socket 20 is fixed by the direction fixture 24 in parallel with the entire lamp series, the bulbs inserted onto the sockets 20 in series will follow the path or figure as arranged by the electric wires as desired, such as in a straight line or a curve or any pattern, without giving any impression of disorder.

Moreover, the direction is positive to give a good light flowing effect.

Figure 3:
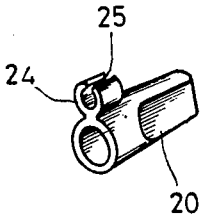
FIG. 3 is a perspective view of a single direction fixture according to the present invention.

Further referring to FIG. 3, the fixture 24 is integrally formed with the socket 20 in parallel. The outer face of the fixture 24 is preferably in registry with the mouth rim of the socket 20 while its length is shorter than said socket 20 to about only one third, but it is not limited here rather may be desirably varied. The fixture 24 is formed with a retaining ring having a hollow circular cross-section, but it is not limited here, elliptical or any other suitable shape may be used. The diameter thereof is less than that of the socket 20, but it is also not limited here and may be desirably varied.

The retaining ring is provided with an elastic access notch 25 for permitting the twisted electric wires 21 and 22 inserted thereonto. The width of the notch is determined by the number of wires twisted together, in other words, greater width is required for more wires. In any case, the width is preferred in an extent that the twisted wires may be inserted onto or pulled out of said notch by slight force but will not be falled out by themselves, since the fixture 24 is integrally formed with the socket 20 by plastics and thus provided with elasticity at the notch 25.

Figure 4:
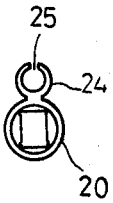
FIG. 4 is the front plain view of FIG. 3.
Figure 5:
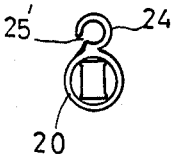
FIG. 5 is an alternative embodiment in similar to FIG. 4.

In the embodiment as shown in FIG. 4, the notch 25 is formed at radial uppermost of circumference, in other words, at the location just opposite to the socket 20. But this location may be displaced. For example, in the embodiment as shown in FIG. 5, it is located at 25, near to the socket 20. Accordingly, other locations can be used.

As mentioned above, the direction fixture according to this invention is simple in structure, easy to manufacture and positive in function.

What I claim is:

1. A direction fixture for decorative lamp series comprising a socket for a bulb, wires connected to said socket and a retaining ring attached to said socket, said retaining ring being provided with a notch extending longitudinally of the socket with the wires that are connected to said socket being positioned and retained in said socket so as to fix said socket in a desired orientation and wherein said retaining ring has an outer face which is in registry with an end rim of said socket.

2. A direction fixture as set forth in claim 1, wherein said retaining ring is integrally formed with said socket.

3. A direction fixture as set forth in claim 1, wherein said retaining ring has a length shorter than that of said socket.

4. A direction fixture as set forth in claim 1, wherein said notch of said retaining ring is formed at a location radially opposite to said socket.

5. A direction fixture as set forth in claim 1, wherein said notch of said retaining ring is formed at a location in close proximity to said socket.

* * * * *